US006032799A

United States Patent [19]

Bellum et al.

[11] Patent Number: 6,032,799

[45] Date of Patent: Mar. 7, 2000

[54] ELECTRONIC ARTICLE SURVEILLANCE LABEL CARTRIDGE AND SYSTEM

[75] Inventors: Karen E. Bellum, Boca Raton; Norman B. Hansen, Highland Beach; Mark D. Krom, Lauderdale; Barbara G. Motooka, Davie, all of Fla.

[73] Assignee: Sensormatic Electronics Corporation, Boca Raton, Fla.

[21] Appl. No.: 08/749,437

[22] Filed: Nov. 15, 1996

[51] Int. Cl.[7] ..... B65D 85/30; B65D 85/62; A47F 1/04; B65H 1/00

[52] U.S. Cl. ..... 206/449; 206/499; 206/718; 221/307; 312/60

[58] Field of Search ..... 221/232, 226, 221/307, 312 R; 229/23 R, 125.19; 312/42, 50, 60; 206/499, 526, 449, 718

[56] References Cited

U.S. PATENT DOCUMENTS

| | | | |
|---|---|---|---|
| 1,246,265 | 11/1917 | Hendler | 220/592.14 |
| 3,127,991 | 4/1964 | Burnett | 206/499 |
| 3,180,489 | 4/1965 | McGinn | 206/499 |
| 3,415,663 | 12/1968 | Raschke et al. | 206/499 X |
| 4,043,485 | 8/1977 | Tippetts | 206/499 X |
| 4,203,521 | 5/1980 | Dunn | 206/525 |
| 4,365,709 | 12/1982 | Lesker | 312/42 X |
| 4,510,489 | 4/1985 | Anderson, III et al. . | |
| 4,769,573 | 9/1988 | Celik | 312/42 X |
| 5,294,068 | 3/1994 | Baro et al. . | |
| 5,357,240 | 10/1994 | Sanford et al. . | |

FOREIGN PATENT DOCUMENTS

| | | | |
|---|---|---|---|
| 282833 | 4/1966 | Australia | 206/526 |
| 2053855 | 2/1981 | United Kingdom | 206/499 |

*Primary Examiner*—Bryon P. Gehman
*Attorney, Agent, or Firm*—Paul T. Kashimba

[57] ABSTRACT

A cartridge for electronic article surveillance labels comprising a housing shaped to hold a plurality of electronic article surveillance labels in a stack such that the electronic article surveillance labels can be removed individually from a first side of the housing and a system utilizing such housing and a plurality of electronic article surveillance labels that are at least semirigid.

20 Claims, 4 Drawing Sheets

FIG. 2
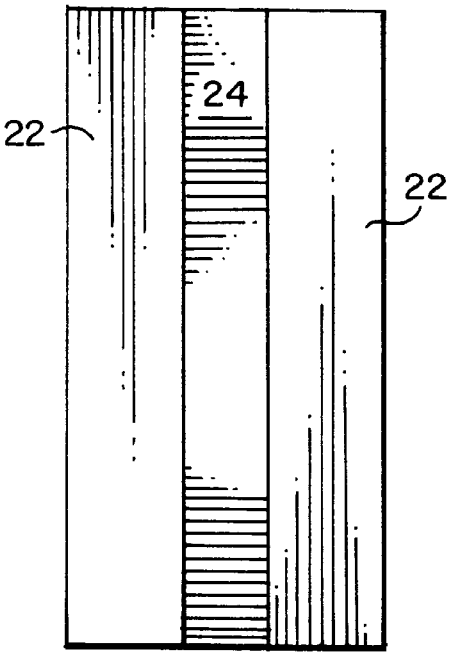
FIG. 3
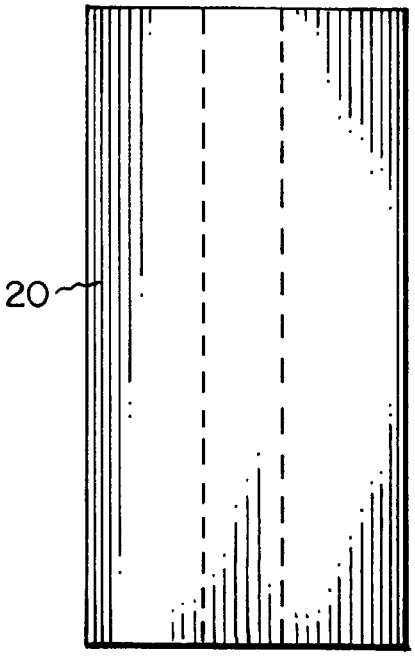
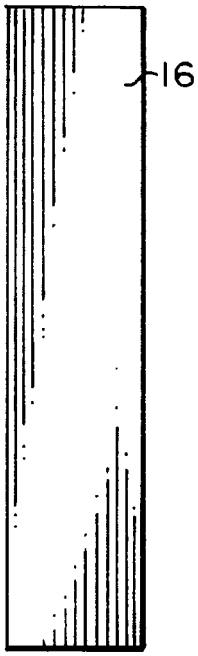
FIG. 4
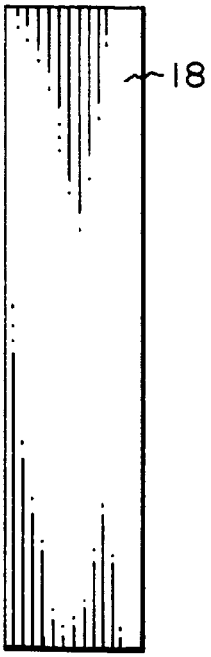
FIG. 5
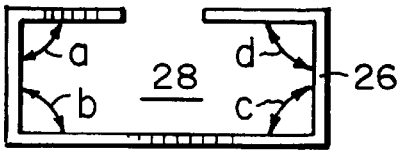
FIG. 6
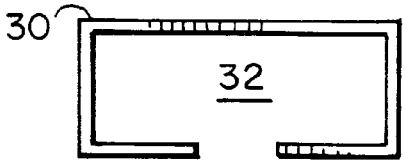
FIG. 7
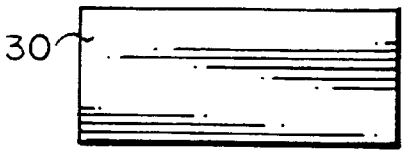
FIG. 8

ELECTRONIC ARTICLE SURVEILLANCE LABEL CARTRIDGE AND SYSTEM

FIELD OF THE INVENTION

This invention relates to electronic article surveillance and, more particularly, to an electronic article surveillance label cartridge and an electronic article surveillance label cartridge system.

BACKGROUND OF THE INVENTION

Electronic article surveillance systems have employed either reusable or disposable electronic article surveillance labels to protect goods from pilferage. The reusable labels normally placed on the goods at the commercial establishment by a clerk and are removed from the goods by the clerk with a special tool before the customer exits the store. The label is then reused by having the clerk place the label on another article. The disposable labels are generally attached to the packaging by adhesive. These labels are formed in a line on a liner or backing which acts as a carrier for the labels which have a pressure sensitive adhesive. The liner is then wound onto a core to form a roll which is shipped to the commercial establishment. The roll of labels is loaded into a dispenser which detaches individual labels from the roll that are applied to the goods that are to be protected by the electronic article surveillance system. Numerous retail chains and manufacturers desire to facilitate the protection of their goods by source tagging, that is, where the task of protecting the goods with electronic article surveillance labels is performed during manufacture and packaging of the goods rather than at the retail level.

The current method of applying electronic article surveillance labels by stripping them from the liner and applying them to the goods with a dispenser limits the application speed. The roll format also requires rethreading of the dispenser when a new roll is installed which further decreases the overall throughput. In addition, the liner and necessary dead space between the labels in the rolls increases the space required for storing a given label count at the manufacturing facility. The source tagging environment requires a label system that facilitates higher application speeds than available with current application systems and reduces the amount of plant floor requirements for storing the labels.

SUMMARY OF THE INVENTION

In accordance with the present invention there is provided a cartridge for electronic article surveillance labels comprising a housing shaped to hold a plurality of electronic article surveillance labels in a stack such that the electronic article surveillance labels can be removed individually from a first side of the housing.

In addition, the present invention provides an electronic article surveillance label cartridge system comprising a plurality of electronic article surveillance labels that are at least semirigid and a housing shaped to hold the electronic article surveillance labels in a stack such that the electronic article surveillance labels can be removed individually from a first side of the housing.

The housing has second and third sides that are sized to accommodate the largest dimension of the electronic article surveillance label and fourth and fifth sides that are sized to accommodate the second largest dimension of the electronic article surveillance label so that when the electronic article surveillance labels are stacked in the housing the electronic article surveillance labels are stacked in the direction of the smallest dimension of the electronic article surveillance labels. The second, third, fourth, and fifth sides of the housing are sized so that the electronic article surveillance labels in the stack will fall out of the housing one after the other when the housing is positioned such that the first side of the housing is at the bottom. One or more, and preferably all, of the interior angles formed by the second, third, fourth, and fifth sides of the housing can be made greater than ninety degrees to ensure the electronic article surveillance labels do not get caught in the corners. In addition, one of the second, third, fourth, and fifth sides of the housing can have a slot that allows access to the electronic article surveillance labels in the stack. The cartridge of the present invention can include a cap that is sized to fit over the first side of the housing to hold the electronic article surveillance labels in the housing. A sixth side of the housing which is opposite the first side can have an aperture which can function in combination with the slot to accommodate high speed application equipment. A cap similar to the cap for the first side can be placed over the sixth side to hold the electronic article surveillance labels in the housing if the aperture is similar in size to the aperture in the first side.

The electronic article surveillance label in the electronic article surveillance label cartridge system of the present invention is at least semirigid and can have different embodiments. In one embodiment the electronic article surveillance labels comprise electronic article surveillance elements, which can be magnetic elements, and a first housing that is at least semirigid with the elements being positioned inside the first housing. In another embodiment the labels comprise electronic article surveillance elements attached to or mounted on a substrate that is at least semirigid.

The present invention provides an electronic article surveillance label cartridge system that can be utilized with other equipment to provide high speed dispensing of the electronic article surveillance labels. The cartridge system also provides a high density for the labels thereby reducing the floor space required in the manufacturing facility. This system can be employed with either drop in applications where the electronic article surveillance label is placed inside the product or its packaging or where an adhesive is supplied to the label for application to the product or its packaging. In either case the combination of an electronic article surveillance label that is at least semirigid and a cartridge for maintaining the labels in the desired configuration provides a system that is readily adaptable to high speed application equipment. The cartridge system of the present invention facilitates and enhances the source tagging program currently being sought by retail chains and manufacturers.

Other objectives, advantages, and applications of the present invention will be made apparent by the following detailed description of the preferred embodiment of the invention.

DESCRIPTION OF THE DRAWINGS

FIG. 2 is a front view of the cartridge shown in FIG. 1.

FIG. 3 is a back view of the cartridge shown in FIG. 1.

FIG. 4 is a left side view of the cartridge shown in FIG. 1.

FIG. 5 is a right side view of the cartridge shown in FIG. 1.

FIG. 6 is a bottom view of the cartridge shown in FIG. 1.

FIG. 7 is a top view of the cartridge shown in FIG. 1.

FIG. 8 is a top view of an alternative embodiment of the cartridge shown in FIG. 1.

DETAILED DESCRIPTION OF PREFERRED EMBODIMENTS

Figure 11:
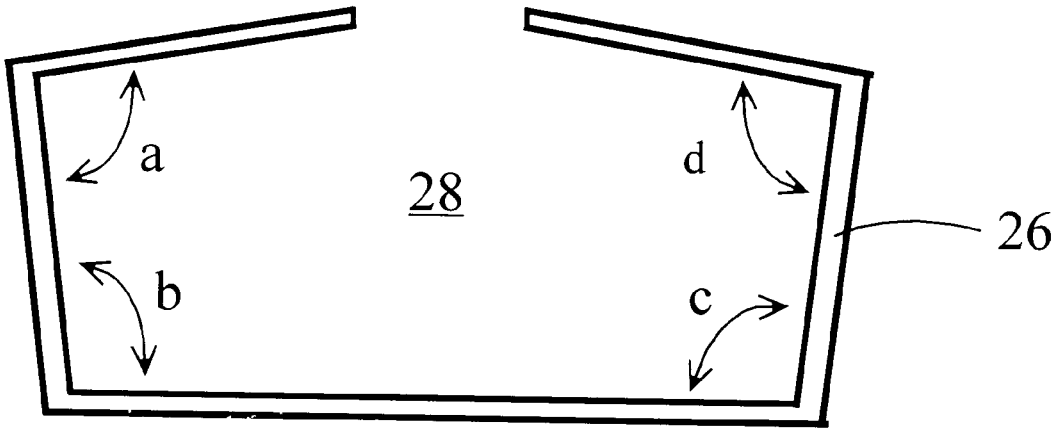
FIG. 11 is a bottom view of an alternative embodiment of the cartridge shown in FIG. 1.

Referring to FIGS. 1 through 8, an electronic article surveillance (EAS) label cartridge system of the present invention is shown generally by numeral 10 and includes a cartridge 12, which can be a sleeve or housing, and a plurality of electronic article surveillance (EAS) labels 14 which are held inside cartridge 12 in a stack. Only a few of the plurality of EAS labels 14 in the stack have been shown at the top and bottom of the stack with the remainder being indicated by dashed and dotted lines for the sake of clarity in the drawing. Cartridge 12 has side walls 16 and 18, back wall 20, and front wall 22. Side walls 16 and 18 and back wall 20 are solid. Front wall 22 can be solid like back wall 20, or it can have a slot 24. Back wall 20 and front wall 22 are sized so that they are slightly larger than the largest dimension of EAS labels 14. Side walls 16 and 18 are sized so that they are slightly larger than the second largest dimension of EAS labels 14 so that EAS labels 14 are stacked in the direction of the smallest dimension of EAS labels 14. Bottom side 26 of cartridge 12 has an aperture 28 that is slightly larger than the dimensions of EAS labels 14 as described above in relation to side walls 16 and 18, back wall 20 and front wall 22 so that when EAS labels 14 are stacked in cartridge 12 and cartridge 12 is turned so that bottom side 26 is at the bottom of cartridge 12, EAS labels 14 will fall out of cartridge 12 one after the other. Top side 30 can have an aperture 32 which can be sized similarly to aperture 28 in bottom side 26, or alternatively it can be solid as shown in FIG. 8. In addition, the interior angles, a, b, c, and d, formed by side walls 16 and 18, back wall 20, and front wall 22 have been shown as being ninety degrees; however, one or more, and preferably all, of the angles can be made greater than ninety degrees to ensure that EAS labels 14 do not get caught in the corners, as shown in FIG. 11.

Slot 24 in front wall 22 can be sized to allow access to EAS labels 14 by means of a tool or even a person's finger in the event that EAS labels 14 stick inside cartridge 12. Although slot 24 has been shown as being located in front wall 22, it should be understood that alternatively it could be located in back wall 20 or side walls 16 and 18. Still further, more than one slot 24 could be located on one or more of side walls 16 and 18, back wall 20, and front wall 22. In addition, slot 24 can function in combination with aperture 32 in top side 30 to allow a member (not shown) from an application tool to apply pressure on EAS labels 14 thereby pushing them out of aperture 28 in bottom side 26 at a controlled rate. In this embodiment aperture 32 and slot 24 can be similarly sized if the tool member is merely rectangular. However, if the end part of the member that would be located inside cartridge 12 and resting against EAS labels 14 is larger than slot 24, then aperture 32 is sized to accommodate the end part and ideally is sized similarly to aperture 28 as shown in FIG. 7.

Cartridge 12 can be made of plastic or other suitable material such as paper, wood, or metal. In any event cartridge 12 must have sufficient rigidity to prevent the twisting and negative torque effect resulting from application pressure applied at the bottom of the stack. In addition, cartridge 12 provides protection of EAS labels 14.

EAS label cartridge system 10 also can include end caps 34 and 36 which are sized to fit over cartridge 12 to hold EAS labels 14 inside cartridge 12. Other arrangements can be utilized to keep EAS labels 14 inside cartridge 12, and the embodiment shown in FIG. 1 for caps 34 and 36 is merely exemplary.

Figure 1:
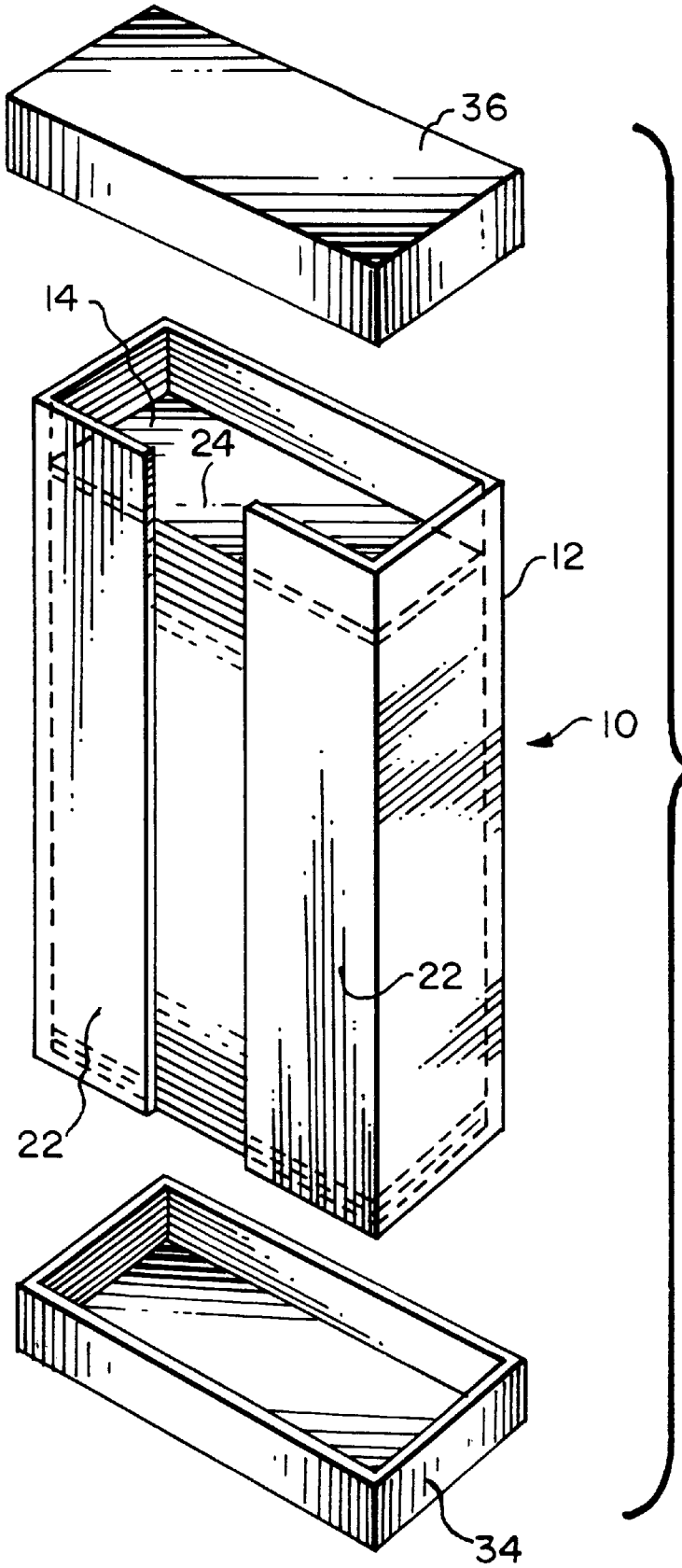
FIG. 1 is a perspective view of a preferred embodiment of the electronic article surveillance label cartridge system of the present invention.
Figure 9:
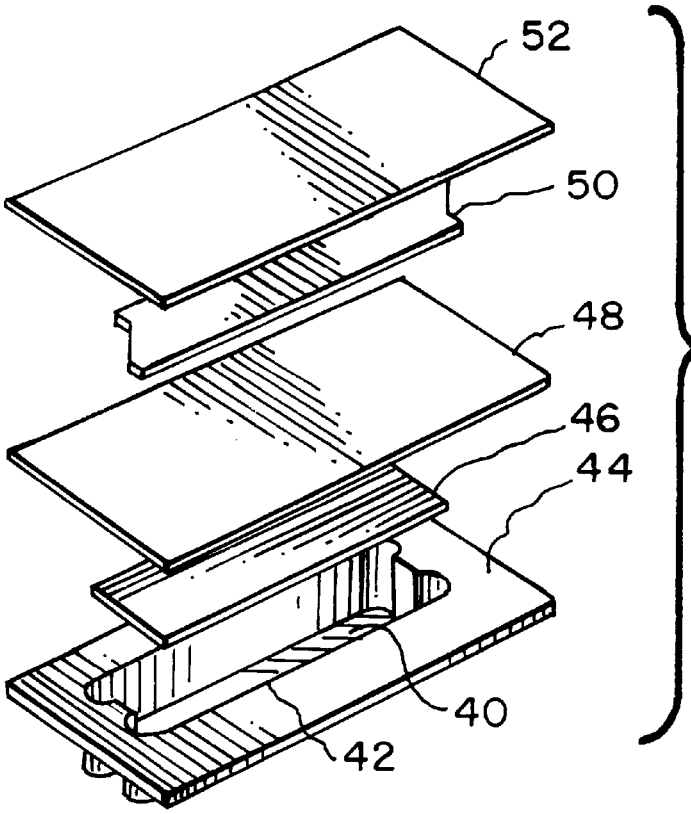
FIG. 9 is a perspective view of a preferred embodiment of an electronic article surveillance label utilized in the electronic article surveillance label cartridge system of the present invention.
Figure 10:
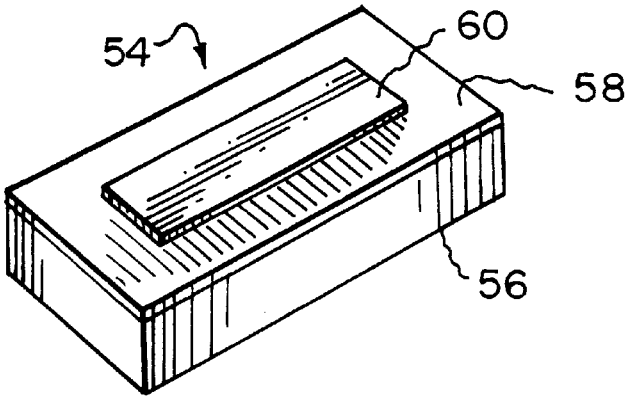
FIG. 10 is a perspective view of an alternative embodiment of an electronic article surveillance label utilized in the electronic article surveillance label cartridge system of the present invention.

Referring to FIG. 9, a preferred embodiment of EAS labels 14 for use with EAS label cartridge system 10 is shown generally by numeral 38. EAS label 38 is a specially designed magnetomechanical EAS label that is similar to the magnetomechanical EAS labels sold by the assignee of this application under the brand name "ULTRA•MAX®". such EAS labels provide excellent performance and are used widely for theft deterrence. EAS label 38 has a housing 40 that has a cavity 42 and a lip 44. Housing 40 is at least semirigid and can be rigid such that it can be pushed from one end under the pressure of the stack and any application tool without flexing or sustaining damage. Magnetic element 46, which mechanically vibrates at a predetermined frequency in response to an interrogation field as taught in U.S. Pat. No. 4,510,490, is positioned inside cavity 42. Film 48 is positioned on lip 44 and sealed thereto. Magnetic element 50, which is a semi-hard or hard magnetic element that biases magnetic element 46 is placed on film 48. Film 52 is then positioned on top of film 48 and magnetic element 50 and is sealed at lip 44. Housing 40 and films 48 and 52 can be constructed of a plastic material suitable for heat sealing such as polyethylene, or for radio frequency welding such as polyvinylchloride. EAS label 38 can be hermetically sealed and constructed of a Food and Drug Administration (FDA) approved material to be suitable for contact with food or pharmaceutical products. Some examples of FDA approved material are as follows: generally plastics and cellophanes and more specifically polyethylene, polypropylene, polyvinylchloride, polyethylene-terephthalate, nylon, polyester, polystyrene and ionomer. It should also be understood that a similar housing could be used to accommodate a radio frequency identification tag rather than the magnetic elements described hereinabove in relation to EAS label 38.

An alternative embodiment of EAS labels 14 that can be utilized with EAS label cartridge system 10 is indicated generally by numeral 54. EAS label 54 has a substrate 56 which has a stiffness that ranges from semirigid to rigid such that it can be pushed from one end under the pressure of the stack and any application tool without flexing or sustaining damage. Substrate 56 can be made of the material described above in relation to EAS label 38. EAS element 60 is positioned on carrier 58, which can be a thin film with an adhesive on one or both sides for holding EAS element 60 on carrier 58 and/or carrier 58 on substrate 56. Other means of attaching EAS element 60 to carrier 58 and carrier 58 to substrate 56 can be used, such as, glue and other adhesives. EAS element 60 can be, for example, a magnetic, magnetic exhibiting a Barkhausen jump, radio frequency, and microwave element as is used in other EAS tags as is known in the art. Alternatively, EAS element 60 can be mounted directly on substrate 56 without carrier 58.

EAS label cartridge system 10 provides a means by which EAS labels 12 can be provided to a high speed application machine for source tagging. EAS label cartridge system 10 can be employed with either drop in applications where the electronic article surveillance label is placed inside the product or its packaging or where an adhesive is supplied to the label for application to the product or its packaging. In either case the combination of EAS labels 14 being at least semirigid and cartridge 12 maintaining the labels in the desired configuration provides a system that is readily adaptable to high speed application equipment. EAS cartridge label system 10 facilitates and enhances the source tagging program currently being sought by retail chains and manufacturers.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. A cartridge for holding rectangular electronic article surveillance labels in a stack, said cartridge comprising: a first side having an aperture so that the electronic article surveillance labels can be removed serially from said cartridge; second and third straight sides that are sized to accommodate the largest dimension of the electronic article surveillance labels; fourth and fifth straight sides that are sized to accommodate the second largest dimension of the electronic articles surveillance labels; and a sixth side opposite said first side, said sixth side having an aperture, said second side contacting said fourth side to form a first interior angle, said second side contacting said fifth side to form a second interior angle, said third side contacting said fourth side to form a third interior angle and said third side contacting said fifth side to form a fourth interior angle, wherein one of said second, third, fourth, and fifth sides has a slot from said first side to said sixth side, thereby dividing the side having the slot into two pieces, and wherein at least one of said first, second, third, and fourth interior angles is greater than ninety degrees.

2. A cartridge for electronic article surveillance labels as recited in claim 1, wherein said second, third, fourth and fifth sides are sized so that the electronic article surveillance labels in the stack will fall out of said cartridge one after the other when said cartridge is positioned such that said first side is at the bottom of said cartridge.

3. A cartridge for electronic article surveillance labels as recited in claim 2, further comprising a cap sized to fit over said first side to hold the electronic article surveillance labels in said cartridge.

4. A cartridge for electronic article surveillance labels as recited in claim 1, wherein said aperture in said sixth side is about the size of the electronic article surveillance labels.

5. A cartridge for electronic article surveillance labels as recited in claim 4, where comprising caps sized to fit over said first and sixth sides to hold the electronic article surveillance labels in said cartridge.

6. An electronic article surveillance label cartridge system as recited in claim 4, wherein all four of said first, second, third and fourth interior angles are greater than ninety degrees.

7. A cartridge for electronic article surveillance labels as recited in claim 4, wherein said cartridge is made of plastic.

8. An electronic article surveillance label cartridge system as recited in claim 1, wherein all four of said first, second, third and fourth interior angles are greater than ninety degrees.

9. An electric article surveillance label cartridge system comprising: a plurality of electronic article surveillance labels that are at least semirigid and a cartridge shaped to hold said electronic article surveillance labels in a stack, said cartridge having a first side with an aperture sized so that said electronic article surveillance labels can be removed serially from said cartridge, second and third sides that are sized to accommodate the largest dimension of said electronic article surveillance labels, fourth and fifth sides that are sized to accommodate the second largest dimension of said electronic article surveillance labels and a sixth side opposite said first side, said sixth side having an aperture, said second side contacts said fourth side to form a first interior angle, said second side contacts said fifth side to form a second interior angle, said third side contacts said fourth side to form a third interior angle and said third side contacts said fifth side to form a fourth Interior angle, wherein one of said second, third, fourth, and fifth sides has a slot from said first side to said sixth side, thereby dividing the side having the slot into to pieces, and wherein at least one of said first, second, third, and fourth interior angles Is greater than ninety degrees.

10. An electronic article surveillance label system as recited in claim 9, wherein all four of said first, second, third and fourth Interior angles are greater than ninety degrees.

11. An electronic article surveillance label cartridge system comprising: comprising: a plurality of electronic article surveillance labels that are at least semirigid and a cartridge shaped to hold said electronic article surveillance labels in a stack, said cartridge having a first side with an aperture sized so that said electronic article surveillance labels can be removed serially from said cartridge, second and third sides that are sized to accommodate the largest dimension of said electronic article surveillance labels, fourth and fifth sides that are sized to accommodate the second largest dimension of said electronic article surveillance labels so that said electronic article surveillance labels in said stack will fall out of said cartridge one after the other when said cartridge is positioned such that said first side is at the bottom of said cartridge, and a sixth side opposite said first side, said sixth side having an aperture that is about the size of said electronic article surveillance labels, said second side contacts said fourth side to form a first interior angle, said second side contacts said fifth side to form a second interior angle, said third side contacts said fourth side to form a third interior angle and said third side contacts said fifth side to form a fourth interior angle, wherein one of said second, third, fourth, and fifth sides has a slot from said first side to said sixth side, thereby dividing the side having the slot into two pieces, and wherein at least one of said first, second, third, and fourth interior angles is greater than ninety degrees.

12. An electronic article surveillance label cartridge system as recited in claim 2, further comprising a cap sized to fit over said first side to hold said electronic article surveillance labels in said cartridge.

13. An electronic article surveillance label cartridge system as recited in claim 11, further comprising caps sized to fit over said first and sixth sides to hold said electronic article surveillance labels in said cartridge.

14. An electronic article surveillance label cartridge system as recited in claim 11, wherein said cartridge is made of plastic.

15. An electronic article surveillance label cartridge system as recited in claim 11, wherein said electronic article surveillance labels comprise an electronic article surveillance element attached to a substrate that is at least semirigid.

16. An electronic article surveillance label cartridge system as recited in claim 15, wherein said electronic article surveillance element is attached to a flexible substrate that is attached to said substrate that is at least semirigid.

17. An electronic article surveillance label cartridge system as recited in claim 2, wherein said electronic article surveillance labels comprise an electronic article surveillance element and a housing that is at least semirigid, said electronic article surveillance element being positioned inside said housing.

18. An electronic article surveillance label cartridge system as recited in claim 17, wherein said electronic article surveillance element of said electronic article surveillance labels comprises a magnetic element.

19. An electronic article surveillance label cartridge system as recited in claim 18, wherein said magnetic element comprises a magnetomechanical marker.

20. An electronic article surveillance label cartridge system as recited in claim 11, wherein all four of said first, second, third and fourth interior angles are greater than ninety degrees.

* * * * *

UNITED STATES PATENT AND TRADEMARK OFFICE

CERTIFICATE OF CORRECTION

PATENT NO : 6,032,799

DATED : March 7, 2000

INVENTOR(S) : Bellum, et al.

It is certified that error appears in the above-identified patent and that said Letters Patent are hereby corrected as shown below:

Front page, item 75, line 3, insert --Ft.-- before "Lauderdale".

Column 6, line 16, change "Interior" to --interior--.

Column 6, line 19, change "to" to --two--.

Column 6, line 20, change "Is" to --is--.

Column 6, line 24, change "Interior" to --interior--.

Column 6, line 53, change "2" to --11--.

Column 7, line 6, change "2" to --11--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*